US012049715B2

(12) United States Patent
Martin et al.

(10) Patent No.: US 12,049,715 B2
(45) Date of Patent: Jul. 30, 2024

(54) KNITTED BAG AND METHOD OF MANUFACTURING THE SAME

(71) Applicant: Rothy's, Inc., San Francisco, CA (US)

(72) Inventors: William Roth Martin, San Francisco, CA (US); Shengquan Zhou, Dongguan (CN); La Vion Gibson, San Franciso, CA (US)

(73) Assignee: ROTHY'S, INC., San Francisco, CA (US)

( * ) Notice: Subject to any disclaimer, the term of this patent is extended or adjusted under 35 U.S.C. 154(b) by 229 days.

(21) Appl. No.: 17/188,586

(22) Filed: Mar. 1, 2021

(65) Prior Publication Data

US 2021/0307466 A1 Oct. 7, 2021

(30) Foreign Application Priority Data

Mar. 2, 2020 (CN) ..... 202010137170.X

(51) Int. Cl.

| | |
|---|---|
| ***D04B 1/22*** | (2006.01) |
| ***A45C 3/00*** | (2006.01) |
| ***A45C 3/06*** | (2006.01) |
| ***D04B 1/12*** | (2006.01) |
| ***D04B 1/16*** | (2006.01) |

(52) U.S. Cl.

CPC ..... *D04B 1/22* (2013.01); *A45C 3/001* (2013.01); *A45C 3/06* (2013.01); *D04B 1/12* (2013.01); *D04B 1/16* (2013.01)

(58) Field of Classification Search

CPC .... D04B 1/12; D04B 1/16; D04B 1/22; A45C 2003/002; A45C 2003/001

See application file for complete search history.

(56) References Cited

U.S. PATENT DOCUMENTS

| | | | | | |
|---|---|---|---|---|---|
| 459,866 | A * | 9/1891 | Clewley | D04B 21/20 | 66/196 |
| 2,322,688 | A * | 6/1943 | Glick | A45C 3/04 | 383/66 |
| 2,565,283 | A * | 8/1951 | Hamilton | A45C 3/06 | D3/244 |
| 3,331,221 | A * | 7/1967 | Lawson, Jr. | D04B 21/12 | 206/0.5 |
| 3,807,200 | A * | 4/1974 | Liwski | D04B 3/00 | 66/170 |
| 4,010,055 | A * | 3/1977 | Oka | B65D 75/08 | 156/290 |

(Continued)

FOREIGN PATENT DOCUMENTS

| | | | |
|---|---|---|---|
| KR | 30-0976219 | S | 10/2018 |
| KR | 30-0978403 | S | 10/2018 |
| KR | 30-1068071 | S | 7/2020 |

*Primary Examiner* — Danny Worrell

(74) *Attorney, Agent, or Firm* — ArentFox Schiff LLP

(57) ABSTRACT

A knitted bag made by a fly-knit technique is provided in which the knitted bag includes a main body formed by a main body sheet substrate knitted at one time by a fly-knit loom. Moreover, the main body sheet substrate is constructed to be directly sewed into a predetermined shape of the bag after a process of hand stitching and bending. The main body sheet substrate has a multi-layer sheet structure, and the number of layers of fabric of the main body sheet substrate in at least a portion of bent regions is smaller than the number of layers of fabric in other regions.

16 Claims, 11 Drawing Sheets

(56) References Cited

U.S. PATENT DOCUMENTS 4,388,739 A * 6/1983 Martinon ..... D06F 95/006 8/150
4,785,613 A * 11/1988 Rhode ..... D04B 21/20 66/195
5,038,585 A * 8/1991 Robinson ..... D04B 1/108 66/170
5,638,703 A * 6/1997 Callaway ..... D04B 21/20 66/195
5,855,231 A * 1/1999 Mintz ..... D04B 1/102 428/36.1
7,191,621 B2 * 3/2007 Zheng ..... E02B 3/127 66/170
7,293,433 B1 * 11/2007 McMurray ..... D04B 21/08 66/170
9,604,757 B2 * 3/2017 Spivack ..... B62B 3/146
10,145,044 B2 * 12/2018 Schenk ..... D04B 21/20
10,893,734 B1 * 1/2021 Bell ..... E05B 73/0005
11,213,115 B1 * 1/2022 Flynn ..... A45F 5/021
2004/0011085 A1 * 1/2004 Sciacca ..... D04B 1/22 66/8
2004/0032992 A1 * 2/2004 Hershku ..... B65D 29/04 383/117
2006/0266294 A1 * 11/2006 Holmes ..... A47G 9/08 119/28.5
2007/0000288 A1 * 1/2007 Giro Amigo ..... D04B 25/02 66/195
2009/0010572 A1 * 1/2009 Knijff ..... B65D 29/04 383/22
2010/0089958 A1 * 4/2010 Flagel ..... A47G 9/062 224/576
2012/0279260 A1 * 11/2012 Dua ..... D04B 21/08 66/171
2017/0022640 A1 * 1/2017 Schenk ..... A45C 3/001
2018/0146759 A1 * 5/2018 Godshaw ..... A45C 13/18
2021/0130988 A1 * 5/2021 Marin ..... D02G 3/04
2021/0321733 A1 * 10/2021 Muller ..... A45C 13/086

* cited by examiner

KNITTED BAG AND METHOD OF MANUFACTURING THE SAME

CROSS REFERENCE TO RELATED APPLICATIONS

The present application claims priority to Chinese Patent Application No. 202010137170.X, filed Mar. 2, 2020, the entire contents of which are hereby incorporated by reference.

TECHNICAL FIELD

The present invention relates to a field of a knitted bag and a method of manufacturing the same.

BACKGROUND

People usually carry satchels, handbags, etc. with them to put inside small items such as tissues and cosmetics that might be used at any time. Conventional satchels and handbags may be prepared from animal leather, artificial leather, plant material fabrics, nylon cloth, and the like. It is well known that animal leather can only be obtained at the cost of animals' life. Artificial leather generally suffers from aging problems. Plant material fabrics are susceptible to damp and mildew, so that their life cycle is relatively short. Nylon cloth is a synthetic chemical material, and causes a lot of pollution problems during its manufacture process. Therefore, there is a desire to find a durable and nature-friendly material.

It is known that substances made of materials that are not easily oxidized and decomposed by nature, such as plastic bottles and plastic bags, are randomly discarded and carried by water to flow into the ocean, causing the white pollution. Some companies have recycled the white trash in the ocean and produced fiber products such as marine yarn with a long service life. Generally, in order to ensure the service life of the products, the company will knit the marine yarn into a fabric cloth with a multi-layer structure, and then make the final products with the fabric cloth. The problem caused by this manufacture process is that the fabric cloth with the multi-layer structure is not easy to bend, so that workers requires burning energy in order to bend the fabric cloth and keep it at the bent position before sewing. Workers have to put huge amounts of effort into manufacturing small-sized bag-like articles such as satchels and handbags.

Another characteristic of the marine yarn is that it has excellent ductility. After being subject to a certain tensile force, the fabric cloth made of the marine yarn is easy to be elongated. Therefore, this material is only suitable for the manufacture of products that will not bear a large tensile force, such as shoes. Since satchels, handbags, etc. are usually used to hold various items therein, they will bear variously tensile forces. Therefore, the fabric cloth made of the marine yarn is not adapted to make such bags.

SUMMARY OF THE INVENTION

Accordingly, it is an object of the present invention to provide a knitted bag which is easy to make and a method of manufacturing the same, wherein the knitted bag is made by a flyknit technique.

In an exemplary aspect, the knitted bag includes a main body portion formed by a main body sheet substrate knitted at one time by a flyknit loom, the main body sheet substrate being configured to be directly sewed into a predetermined shape of the bag after a process of hand stitching and bending, wherein the main body sheet substrate has a multi-layer sheet structure, and the number of layers of fabric of the main body sheet substrate in at least a portion of bent regions is smaller than the number of layers of fabric in other regions of the main body sheet substrate.

By arranging a smaller number of layers of fabric at the bent regions, the main body sheet substrate is easier to bend at these bending positions so that the manufacture process of the bag become simpler. Additionally, the portions of the main body sheet substrate adjacent to the bent regions define a structural style of the bag and thus have a large thickness. After the main body sheet substrate is knitted into a bag, the portions of the main body sheet substrate adjacent to the bent regions are sewed to each other. Even though the bag is used to hold heavy items, the external force exerted on the bag is borne by the thicker main body sheet substrate, so that the bag may bear heavy items.

According to a preferred embodiment of the present invention, the main body sheet substrate is a sheet-like fabric knitted from nylon thermal fuses and marine yarns, and having a predetermined shape.

According to another preferred embodiment of the present invention, fineness $T_{d1}$ of the marine yarn is: $120D \leq T_{d1} \leq 180D$.

According to a further preferred embodiment of the present invention, twist T of the marine yarn is: $32F \leq T \leq 40F$.

According to a further preferred embodiment of the present invention, the number of strands of the marine yarn is 3, 4 or 5, the number of nylon thermal fuses is 2, and the fineness $T_{d2}$ of the nylon thermal fuse is: $80D \leq T_{d2} \leq 110D$.

According to a preferred embodiment of the present invention, the diameter d of the nylon thermal fuses is: $0.12\ mm \leq d \leq 0.18\ mm$.

According to a further preferred embodiment of the present invention, the fineness $T_{d1}$ of the marine yarn is 150D, the number of strands is 4, and the twist T is 36F; and the fineness $T_{d2}$ of the nylon thermal fuses is 90D or 100D.

After selecting and setting the ratio of the nylon thermal fuses and marine yarns as described above, in the process of producing the main body sheet substrate, the nylon thermal fuses fused to the marine yarns will greatly adjust the extensibility of the marine yarns, so that the resultant bag is more prone to maintain its original shape, thereby achieving another object of the present invention.

According to a further preferred embodiment of the present invention, the main body sheet substrate forms said portion of the bent regions extending in a lengthwise direction, a widthwise direction or a height direction of the bag at a plurality of bent positions for forming a bottom portion and/or a top portion of the bag, respectively.

According to a further preferred embodiment of the present invention, said portion of the bent regions are knitted by a process of transferring to single jersey, so that the main body sheet substrate can obtain a smooth transition between the surfaces with different orientations at the portion of the bent regions.

According to a further preferred embodiment of the present invention, the portion of the bent regions is knitted by a process of dropping one or more stitches, so that the main body sheet substrate lacks one or more layers on an inner side of the knitted bag to form a groove.

According to a further preferred embodiment of the present invention, another portion of the bent regions is knitted by a process of gore knitting, so that the main body sheet substrate bulges toward the outside of the bag at the another portion of the bent regions.

According to a further preferred embodiment of the present invention, an edge of the main body sheet substrate has a piped region.

According to a further preferred embodiment of the present invention, the knitted bag further comprises a knitted band used as a handle of the knitted bag and having a multi-layer sheet structure, the number of layers of the fabric in a middle region of the knitted band at a position along its longitudinal centerline is smaller than the number of layers of the fabric at other positions, so that the knitted band can be folded in half at the middle region along the longitudinal centerline of the knitted band, to form a grip portion of the handle.

According to a further preferred embodiment of the present invention, the knitted bag further comprises a fixing band located at the outside of the bottom portion of the bag, wherein the hardness of the fixing band is greater than that of the main body sheet substrate.

In addition, the present invention further relates to a method for making the knitted bag according to the present invention. Specifically, the method comprises producing the main body sheet substrate for forming the main body portion of the bag by knitting at one time by a flyknit loom, wherein the main body sheet substrate has a multi-layer sheet structure, and the number of layers of fabric of the main body sheet substrate in at least a portion of bent regions is smaller than the number of layers of fabric in other regions of the main body sheet substrate; performing hand stitching; bending the main body sheet substrate in light of a predetermined shape of the bag; and sewing adjacent edges of the main body sheet substrate to form the bag with the predetermined shape.

According to a preferred embodiment of the present invention, the method further comprises: ironing the main body sheet substrate after the hand stitching step to shape the main body sheet substrate.

According to another preferred embodiment of the present invention, the surface of the main body sheet substrate has a pattern; the method further comprises ironing the main body sheet substrate after the hand stitching step to adjust and shape a form of the pattern.

According to a further preferred embodiment of the present invention, the method further comprises: providing the knitted band knitted at one time by a flyknit technique and fixing the knitted band to the bag, wherein the knitted bag has a multi-layer structure and is configured to have a number of layers of fabric in a middle region of the knitted band at a position along its longitudinal centerline smaller than the number of layers of the fabric at other positions, so that the knitted band can be folded in half along its longitudinal centerline of the knitted band, to form a grip portion of the knitted bag.

It is noted that under the premise of conforming to common knowledge in the art, the above-described preferred conditions may be combined optionally to obtain preferred embodiments of the present invention.

The knitted bag of the present invention has the following advantages:

The manufacture of the bag is made easier by setting the fabric cloth thinner at the positions to be bent by dropping one or more stitches. Besides, by means of the dropping process, grooves can be formed at the surface layer and the bottom layer due to a smaller number of layers of fabric on the outer side or inner side of the bag. Since the grooves are formed in the knitting process, they have a regular shape and can be used as a thread receiving groove. Upon completion of the sewing, threads are located in the grooves, so that the thread ends are unexposed to the outside. This may make the knitted bag have an excellent appearance and can prevent the knitted bag from damage in the event that the thread ends are accidentally pulled out, thereby pulling the thread.

The positions necessary to be bent are set to be thinner by the process of transferring to single jersey, which also facilitate the fabrication of the bag. In addition, the main body sheet substrate can obtain smooth transitions between the adjacent regions and the bent regions fabricated by the process of transferring to single jersey.

The special ratio of nylon thermal fuses and marine yarns can effectively overcome the disadvantage in the extensibility of marine yarns and ensure that the knitted bag is not easy to deform.

BRIEF DESCRIPTIONS OF THE DRAWINGS

The above objects, as well as additional objects, features and advantages of the present disclosure, will be more fully appreciated by reference to the following illustrative and non-limiting detailed description of example embodiments of the present disclosure, when taken in conjunction with the accompanying drawings.

DETAILED DESCRIPTION OF EMBODIMENTS

The present disclosure will now be described with reference to the accompanying drawings, in which preferred example embodiments of the disclosure are shown. The disclosure may, however, be embodied in other forms and should not be construed as limited to the herein disclosed embodiments. The disclosed embodiments are provided to fully convey the scope of the disclosure to the skilled person. Those skilled in the art can envisage other ways to implement the present invention on the basis of the preferred embodiments, and these other ways also fall within the scope of the present invention. In the following detailed description, directional terms such as "up", "down", "in", "out", "upright" and "vertical" may be used with reference to the directions described in the figures. The components of the embodiments of the present invention may be placed in a variety of different directions, and the directional terms are used for illustrative purposes and not for limitation.

Figure 1:
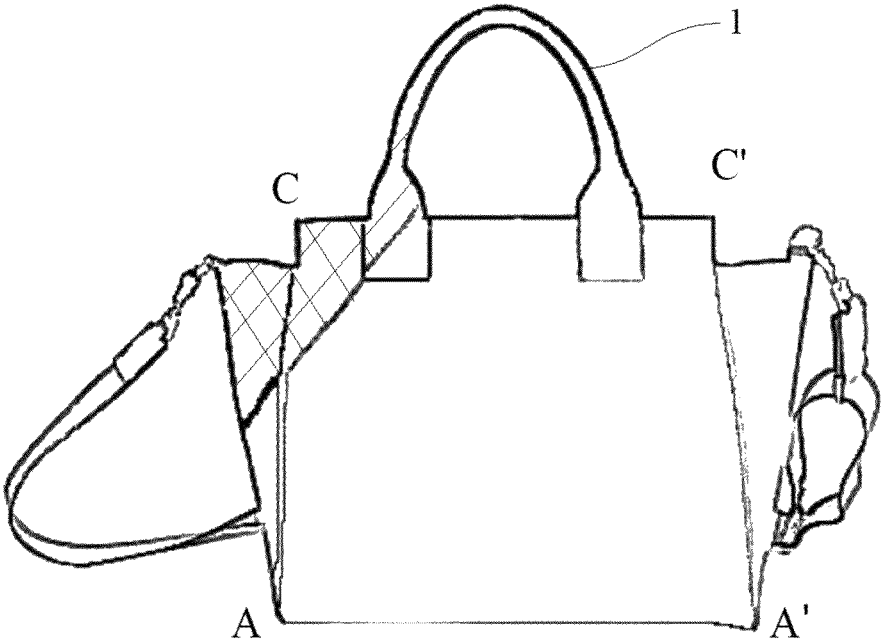
FIGS. 1 and 2 are schematic views of a knitted bag according to a first exemplary embodiment of the present invention.
Figure 2:
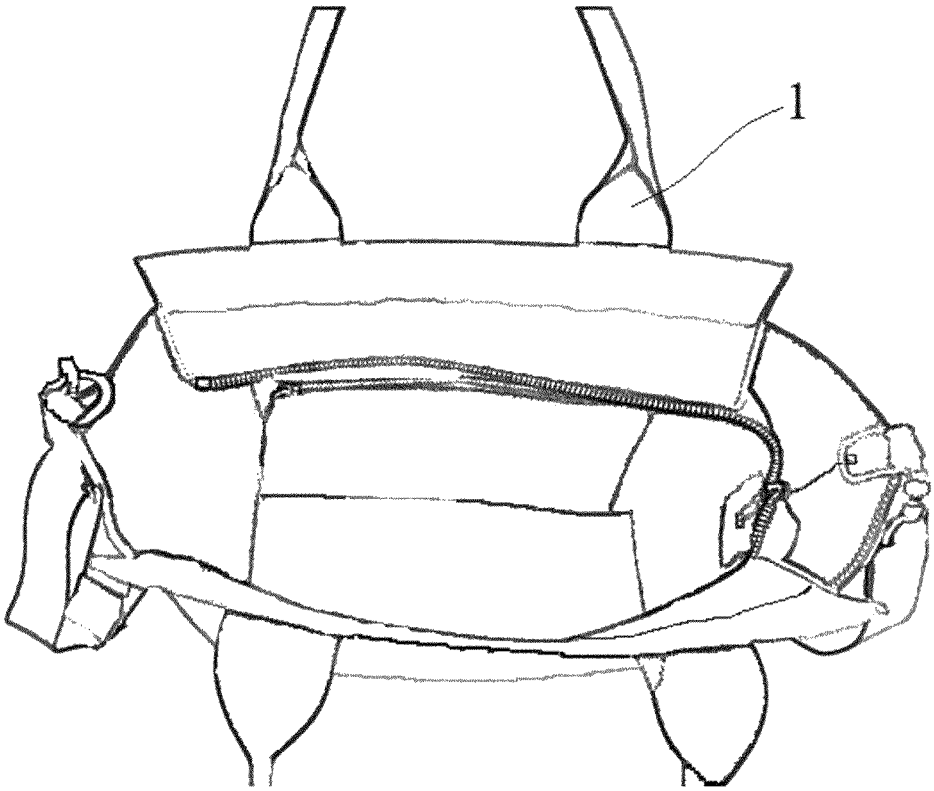

FIGS. 1 and 2 illustrate an example knitted bag according to an exemplary embodiment of the present invention as viewed from different angles. As shown in FIGS. 1 and 2, the knitted bag is manufactured by a flyknit technique. The knitted bag comprises a main body portion, as well as a handle and bands that are fixed on the main body portion. The main body portion defines a space in the knitted body for placing various items. Optionally, as shown in FIG. 2, a built-in small bag may be attached to the interior of the main body portion.

The main body portion in the present invention comprises a main body sheet substrate knitted by a flyknit loom at one time. Specifically, the main body sheet substrate is directly sewn into a predetermined shape of the bag after being hand stitched and bent. The main body sheet substrate has a multi-layer sheet structure, and the number of fabric layers in at least a portion of the bent region of the main body sheet substrate is less than the number of fabric layers in other region. As a result, the main body sheet substrate can be easily bent in a desired bent region to form a corner portion of the bag. The main body sheet substrate adjacent to this portion may be sewn together by a worker. By doing so, the portion of the knitted bag having a smaller number of fabric layers will not bear any tensile force, and the external force exerted on the bag is borne by thicker portions of the main body sheet substrate, the knitted bag can bear a greater tensile force.

The main body sheet substrate is preferably knitted from nylon thermal fuse and marine yarn, and is a sheet-like fabric having a predetermined shape. Wherein, the marine yarn is made of white garbage such as plastic bottles that get into the ocean along with the water flow. Since the marine yarn is a conventional material in the art, it will not be detailed any more here.

In order to use the marine yarn to make the knitted bag according to the present invention, the Applicant knits the nylon thermal fuse and marine yarn by interweaving them together. Advantageously, the fineness Td1 of the marine yarn for making the main body sheet substrate is set to 120D (Denier), . . . 130D, . . . 150D, . . . 180D, etc.; and the twist T is set to 32F, . . . 36F, . . . 40F, etc.

As a monofilament, the fineness Td2 of the nylon thermal fuse is preferably set to 80D, . . . 100D, . . . 1 10D, etc., and its diameter is set to 0.12 mm, . . . 0.15 mm, . . . 0.18 mm, etc.

Most preferably, the fineness Td1 of the marine yarn is set to 150D, the twist T is set to 36F; the fineness Td2 of the nylon thermal fuse is set to 90D or 100D, and its diameter is set to 0.15 mm; the number of strands of the marine yarn is set to 4; the number of the nylon thermal fuses is set to 2. Under this condition, the knitted bag knitted from the 4-strands marine yarn and nylon thermal fuses has a relatively good shaping effect, and at the same time can maintain a soft touch feeling.

Figure 3:
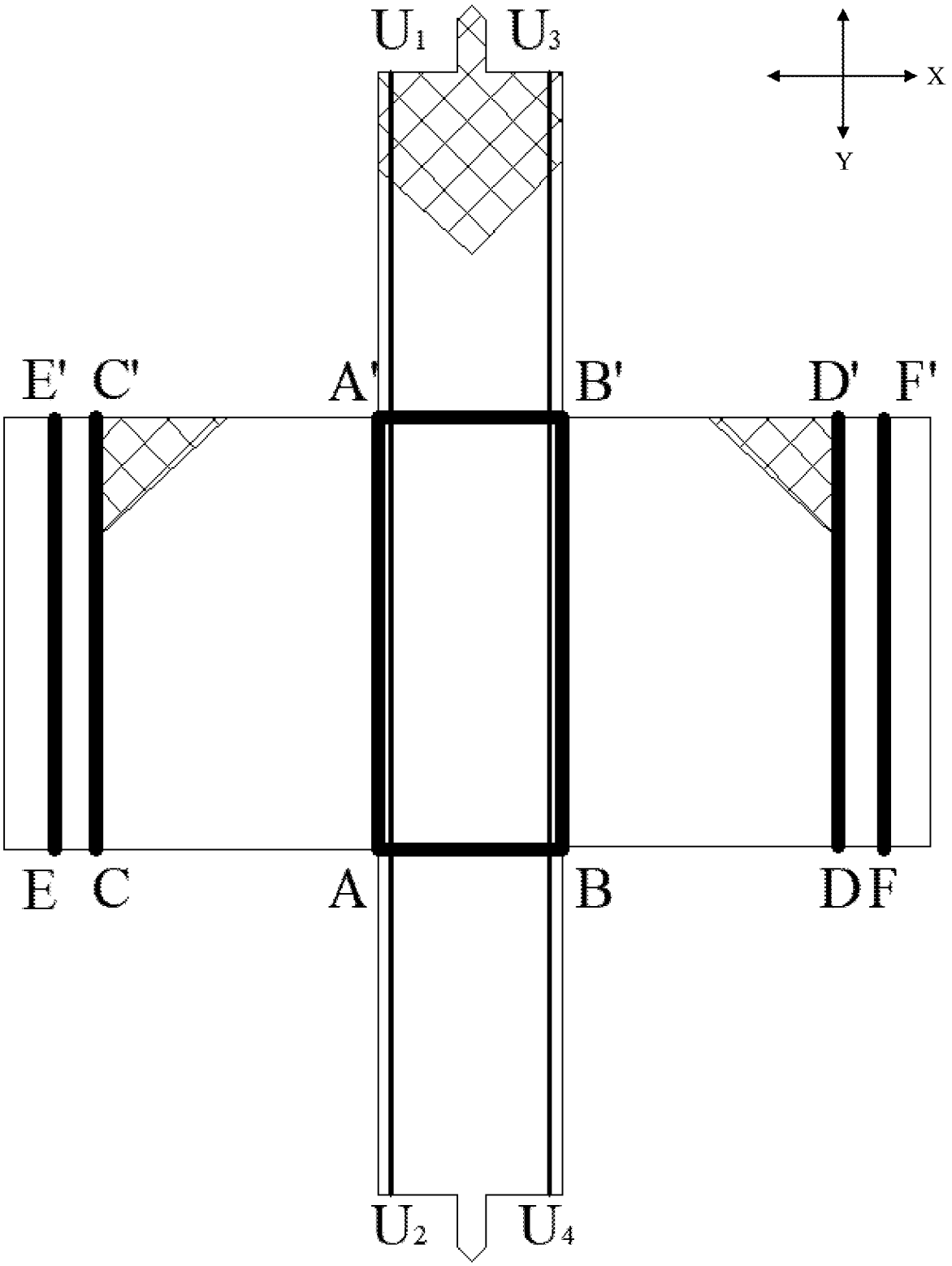
FIG. 3 is a structural schematic diagram of a main body sheet substrate for forming the knitted bag shown in FIGS. 1 and 2.

FIG. 3 shows the main body sheet substrate for manufacturing the main body portion of the knitted bag as shown in FIGS. 1 and 2, which is substantially in a cross shape. In order to better illustrate that the numbers of fabric layers are different at different positions of the main body sheet substrate, in FIG. 3 thicker lines are used to indicate the bent regions with relatively small numbers of fabric layers, and thinner lines are used to define a boundary of the main body sheet substrate and boundaries of patterns on the main body sheet substrate.

In the "+" shaped main body sheet substrate shown in FIG. 3, a middle square block region ABB'A' defined by thicker lines constitutes the bottom portion of the knitted bag; a left lateral protruding portion (the portion containing ACC'A') and a right lateral protruding portion (the portion containing BDD'B') in this region respectively constitute a front side and a back side of the knitted bag; upper and lower protruding portions in this region respectively constitute the sheets material in the width direction of the knitted bag. It will be appreciated that in this view, the extension direction of the left and right lateral protruding portions along the Y axis is the lengthwise direction of the knitted bag, and the extension direction along the X axis is the height direction of the knitted bag. The extension direction of the upper and lower protruding portions (the portion above A'B' and the portion below AB) along the X axis is defined as a "transverse" direction, that is, the thickness direction of the knitted bag.

Hereinafter, the side facing the observer of the main body sheet substrate shown in FIG. 3 is called as an outer side (surface layer) of the knitted bag, and the side facing away from the observer is called as an inner side (bottom layer) of the knitted bag. Referring to FIG. 3 and in conjunction with FIGS. 1 and 2, it will be appreciated that the left and right lateral protruding portions and the upper and lower protruding portions of the middle square block region are respectively bent inward and then stitched the adjoined sides at corresponding positions to form the main body portion of the knitted bag.

Referring to the direction of FIG. 3, the main body sheet substrate is knitted from bottom to top along the Y axis. The main body sheet substrate of FIG. 3 respectively forms longitudinal turning regions AA' and BB' extending along the lengthwise direction of the bag at two bent positions at the bottom portion of the bag to be formed. Similarly, regions CC' and DD' are formed at two bent positions of the top of the bag. The above-described longitudinal turning regions AA', BB', CC', and DD' constitute a longitudinal turning zone, where the number of fabric layers is less than the number of fabric layers in a non-bent regions of the main body sheet substrate.

In addition, the main body sheet substrate further forms transverse turning regions A'B', AB extending in the thickness direction of the bag at the two bent positions of the bottom and/or top of the bag to be formed. In the same way, the transverse turning regions A'B' and AB constitute a transverse turning zone which has fewer fabric layers than other portions of the main body sheet substrate.

Special designs employed in the bent regions of the present invention will be described below with reference to other figures, wherein the signs A1 and A2 in each figure represent a rear stitch, B1 and B2 represent a face stitch, C1 and C2 represent a double stitch, "↑" means that a front stitch bed transfers to a rear stitch bed, "↓" means that the rear stitch bed transfers to the front stitch bed, and "–" represents no stitch.

Figure 4:
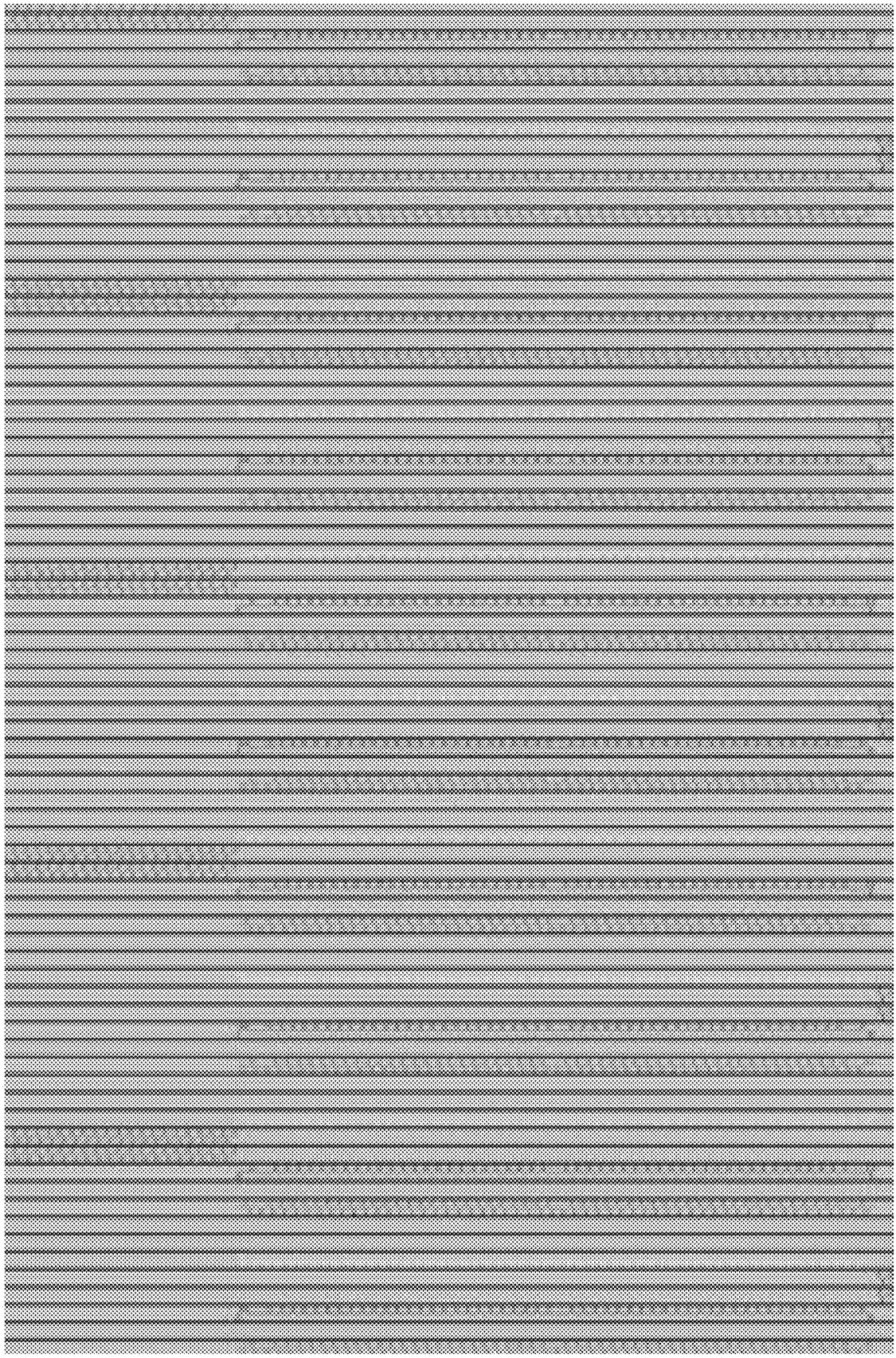
FIG. 4 is a view illustrating a knitting principle of the main body sheet substrate of FIG. 3.

The knitting of the main body sheet substrate may be realized by a flat knitting loom with the front stitch bed and the rear stitch bed. FIG. 4 shows a process diagram of manufacturing the main body sheet substrate as shown in FIG. 3.

According to the first embodiment, the longitudinal turning regions AA', BB', CC', DD' are produced by dropping multiple stitches, so that the main body sheet substrate lacks one or more layers at the turning regions and on the inner side of the knitted bag.

Figure 5:
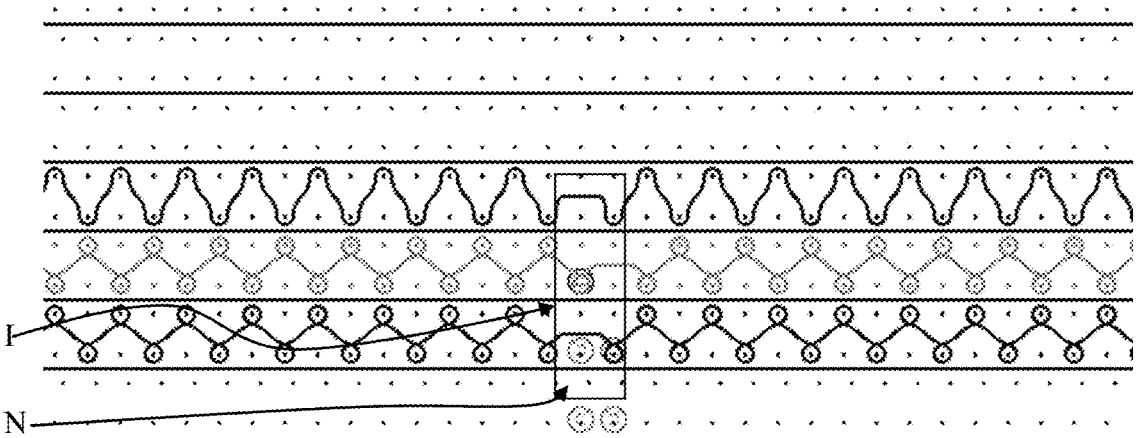
FIG. 5 is a knitting principle diagram illustrating a bent region in which the bottom layer is dropped two stiches and its adjacent regions.
Figure 6:
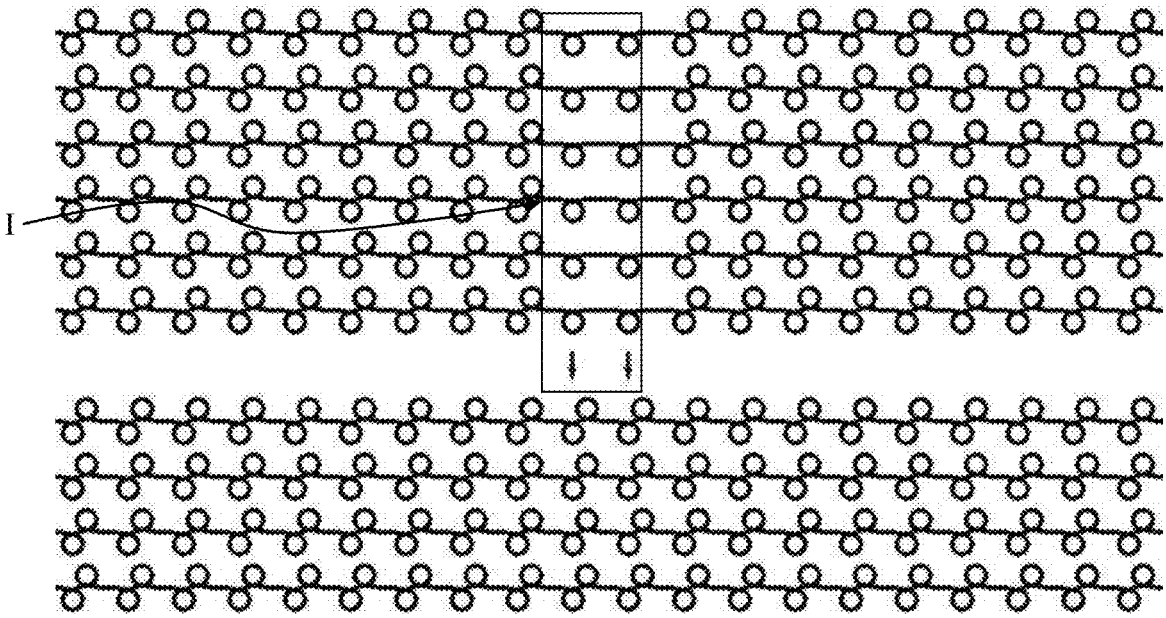
FIG. 6 is a diagram of a knitting process of FIG. 5.

Regarding the process of dropping multiple stitches, reference may be made to FIG. 5-FIG. 6 which illustrate a knitting principle of dropping two stitches from the two-layered fabric, and the structure corresponding to the regions AA', BB', CC and their adjacent positions shown in FIG. 3 can be understood with reference to FIG. 5- FIG. 6. In the first row (counting from bottom to top in FIG. 5), a yarn nozzle first knits double stitches, and then changes to knit no stitch at the position of the Nth stitch, and then continues to knit in double stitches. In the second row, the yarn nozzle similarly first knits double stitches to the position of the Nth stitch, and then the rear stitch bed transfers (with reference to two arrows shown in FIG. 6) to knit no stitch at the N+1th stitch, and then continues to knit in double stitches. In the third row, the yarn nozzle first knits in tuck stitches, and then changes to knit no stitch at the position of the Nth stitch, afterwards continues to knit in tuck stitches. By doing so, the fabric has a bi-layered structure at other positions, but only has a one fabric layer formed on the surface layer at the positions of the Nth stitch and the N+1th stitch, and lacks one layer at the bottom layer (the layer inside the paper in FIG. 3), (i.e., two stitches are dropped at the bottom). Referring to FIG. 6, knitting is performed repeatedly in this order, so that bent regions having bottom dropping layers AA', BB', CC' and DD' extending in the longitudinal direction as shown in FIG. 3 are formed on the main body sheet substrate. Reference may be made to the region I shown in FIGS. 5 and 7 for the bottom dropping layers thus formed.

Figure 7:
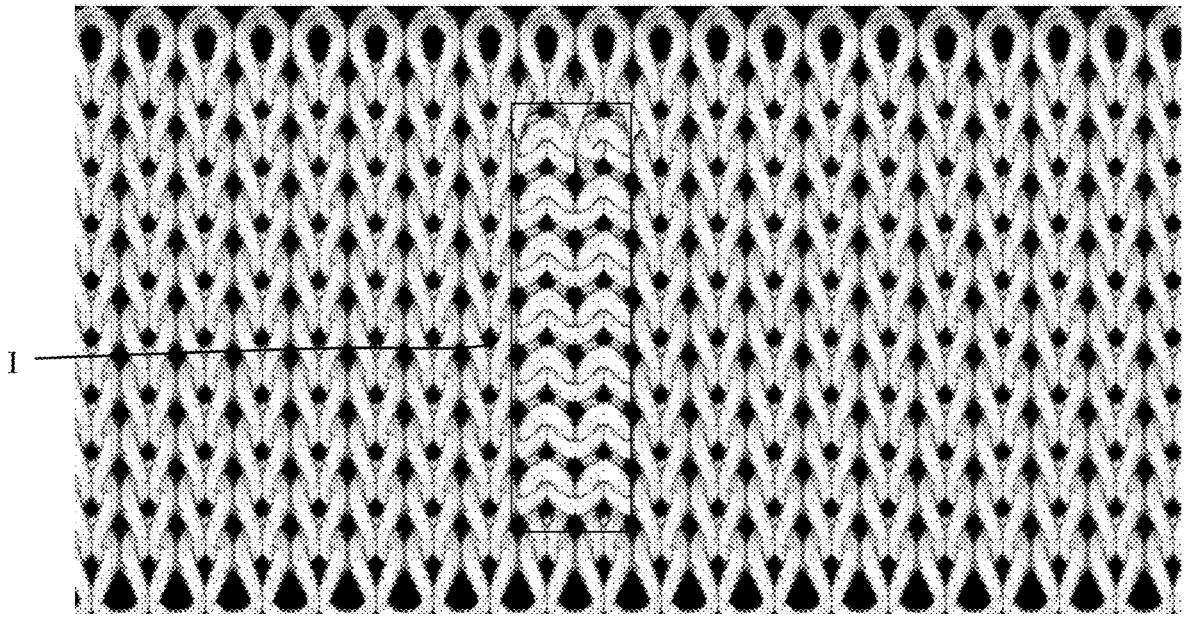
FIG. 7 is a diagram of a physical knitted fabric knitted in a manner shown in FIGS. 5 and 6, wherein the fabric is shown from one side of the bottom layer of the fabric.

Optionally, two bent regions U1U2 and U3U4 with a small number of fabric layers are provided on the main body sheet substrate. In the U1U2 and U3U4 it is preferably to make the bottom layer lack one layer by dropping one stitch. Based on a mechanism principle similar to the above dropping two stitches, i.e., knitting is changed to knit double stitches from the N+1th stitch in the second row, a bent region with one dropped stitch can be formed. Referring to FIG. 7, the regions U1U2 and U3U4 thus formed by dropping one stitch may be in a form of having a width half of the region I of FIG. 7. After the main body sheet substrate is bent and shaped, the regions $U_1U_2$ and $U_3U_4$ offsetting from the bend line AA' and BB' are used as a reference for a travel path of a thread and grooves receiving the thread. Distances of $U_1U_2$ and $U_3U_4$ offsetting from the bend lines AA' and BB' at this time are preferably set to 2 mm, 3 mm, 4 mm, 5 mm, 6 mm, etc., so that the corresponding edges on the region ACC'A' are easily aligned with $U_1U_2$ and $U_3U_4$ and stitched them together with the thread.

Figure 8:
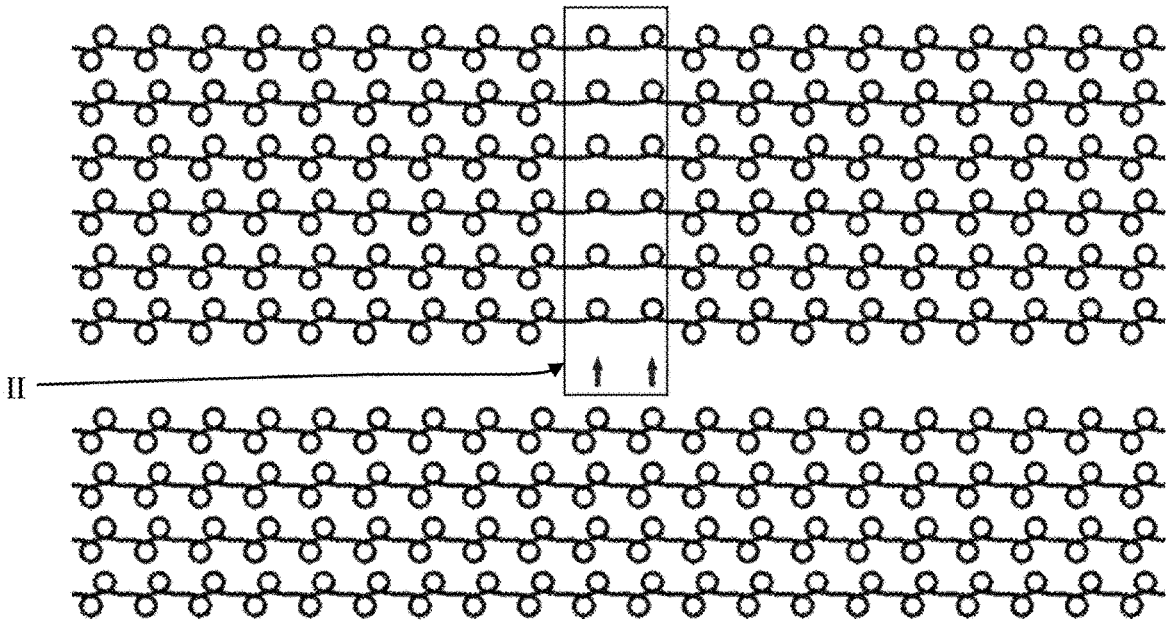
FIG. 8 is a knitting process diagram of a bent region which is dropped two stitches from the surface layer and its adjacent regions.

Reference may be made to region II (namely, EE', FF' in FIG. 3) shown in FIG. 8 for a surface dropping layer. When the knitting goes to the corresponding row where a bend is needed, the face stitch bed transfers to the rear stitch bed, and then the rear stitch knitting is employed. The knitting principle is substantially similar to the knitting principle of the bottom dropping layer. The difference only lies in that the rear stitch knitting is employed at the position of the Nth stitch in the second row (with reference to FIG. 5). The surface dropping layers EE', FF' differ from the bottom dropping layers in that recesses are formed at the surface layer and the bottom layer respectively, thereby facilitating the bending of the main body sheet substrate in different directions.

FIGS. 5-8 illustrate a knitting principle that two stitches in one layer are dropped at the surface layer or bottom layer in the structure of the fabric cloth (i.e., bi-stitch bottom dropped layers formed from left to right in FIG. 5). It should be appreciated that based on the same principle, those skilled in the art may apply it to other bent regions to drop more stitches such as 3 stitches or 4 stitches, and drop more layers such as 2 layers or 3 layers. The above concept also falls within the intended extent of protection of the present invention.

Figure 9:
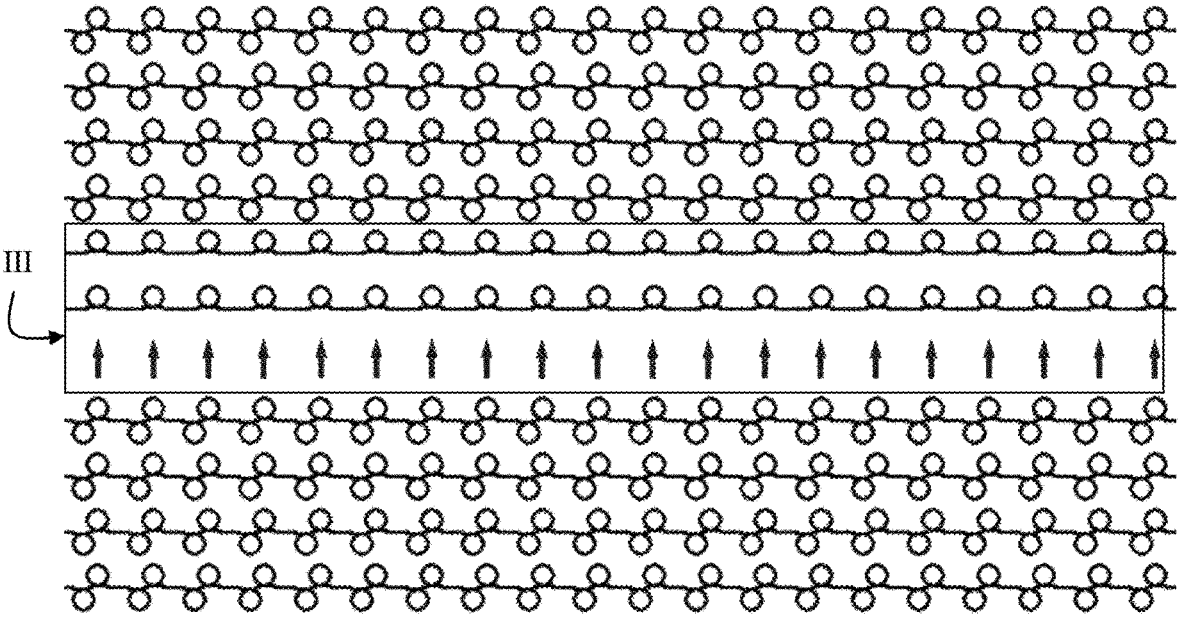
FIG. 9 is a knitting process diagram of a bent region which is dropped an entire row from the surface layer and its adjacent regions.
Figure 10:
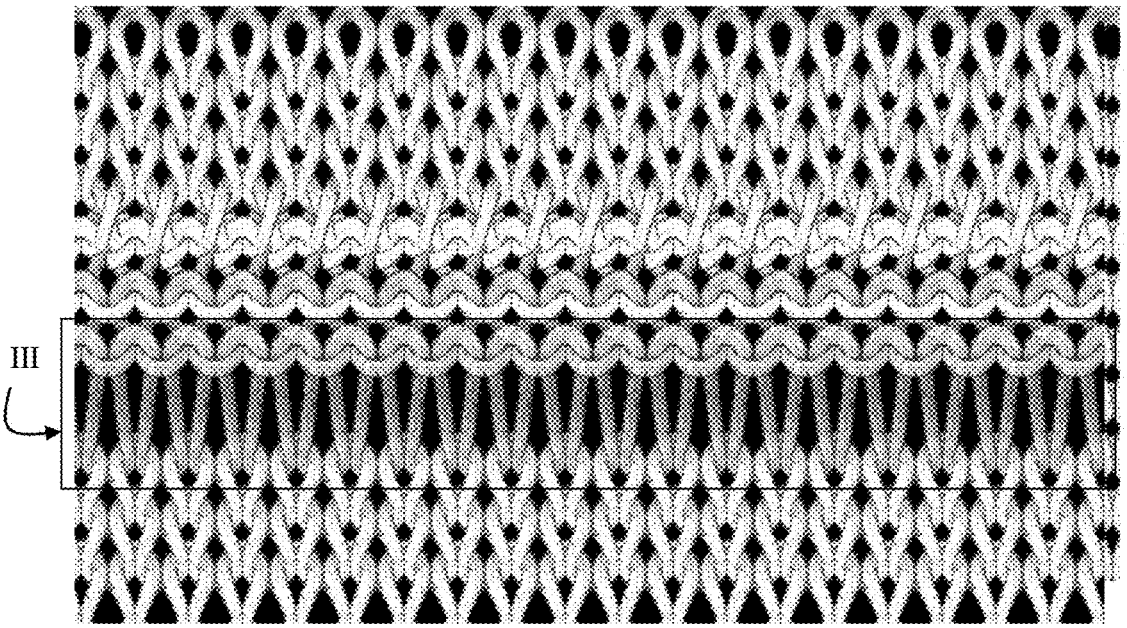
FIG. 10 is a diagram of a physical knitted fabric knitted in a manner shown in FIG. 9, wherein the fabric is shown from one side of the surface layer of the fabric.

FIGS. 5-8 show that the dropping layer along the Y direction of FIG. 3 is manufactured by dropping multiple stitches. The dropping layer in the X direction may be implemented by using the knitting principle shown in FIG. 9 (surface dropping). When the dropping layer (corresponding to the Nth and N+1th row of FIG. 9, namely, region III) extending in the X axis needs to be provided, the yarn nozzle transfers in the target row to knit in the rear stitch (forming the surface dropping layer), instead of the knitting in double stitches at the adjacent rows. Reference may be made to the region III of FIG. 10 for the thus-formed surface dropping layer.

In addition, to form a bent region with a smaller number of layers, according to the second embodiment of the invention, the region may also be formed by a knitting of transferring to single jersey, so that the main body sheet substrate can smoothly transit between the surfaces with different orientations (e.g., between a horizontal plane of the bottom portion and a vertical plane). Different from the knitted region formed by dropping multiple stitches, the region formed by a knitting of transferring to single jersey does not have obvious grooves on the surface layer and the bottom layer (i.e., layer-missed surface layer or bottom layer). As such, it is particularly suitable for the bent regions whose adjacent positions need not to be sewed.

Figure 11:
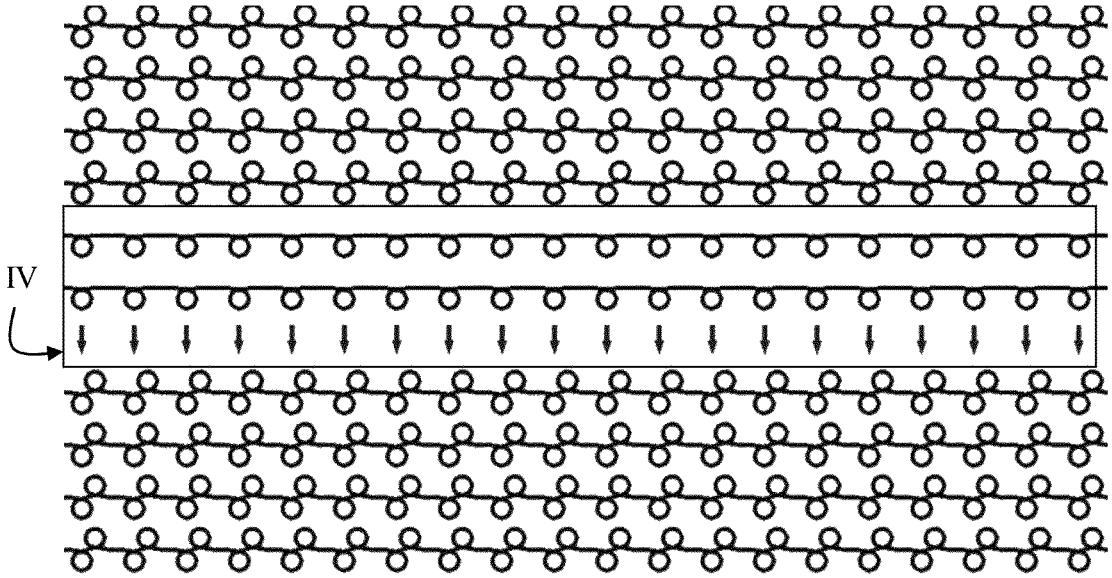
FIG. 11 is a knitting process diagram of a bent region formed by the process of transferring to single jersey, and its adjacent regions.
Figure 12:
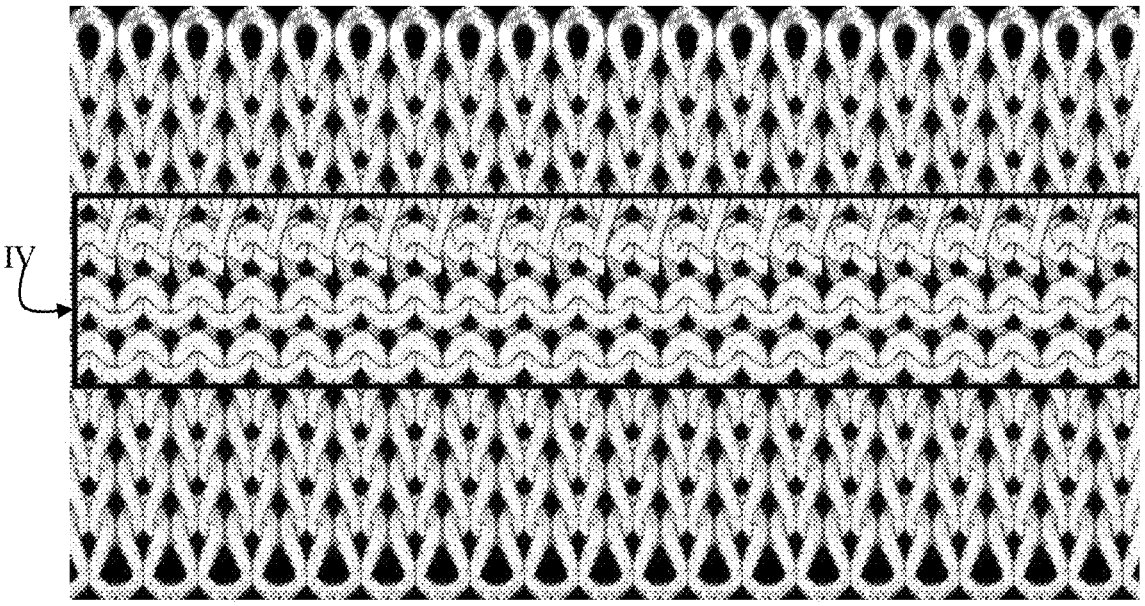
FIG. 12 is a diagram of a physical knitted fabric knitted in a manner shown in FIG. 11.

Regarding the knitting of transferring to single jersey, as shown in FIG. 11, as compared with other rows, where the dropping layer region IV is required to provide by means of transferring to single jersey, the rear stitch bed transfers to the front stitch bed, and the front stitch bed and rear stitch bed change from a manner of respectively knitting one layer to simultaneously knitting one layer. Since the front and rear stitch beds jointly knit one layer, a smooth transition effect of the region IV as shown in FIG. 12 may be achieved by knitting.

Multiple knitting manners of forming a smaller number of layers at the bent regions are described above. In fact, not all of the bent regions are necessarily arranged in this way according to the present invention. For example, some of the bent regions may be arranged in such a way that the main body sheet substrate in these bent regions bulges at the surface layer (or bottom layer) towards the outer side of the bag. This type of bent regions may be produced by a process of gore knitting.

Figure 13:
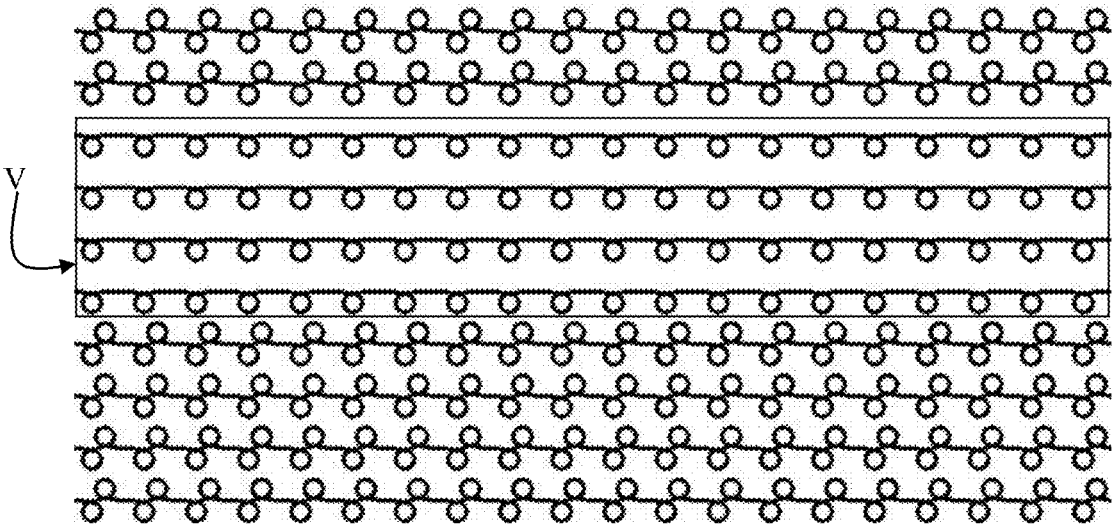
FIG. 13 is a knitting process diagram of a bent region formed by the process of gore knitting, and its adjacent regions.
Figure 14:
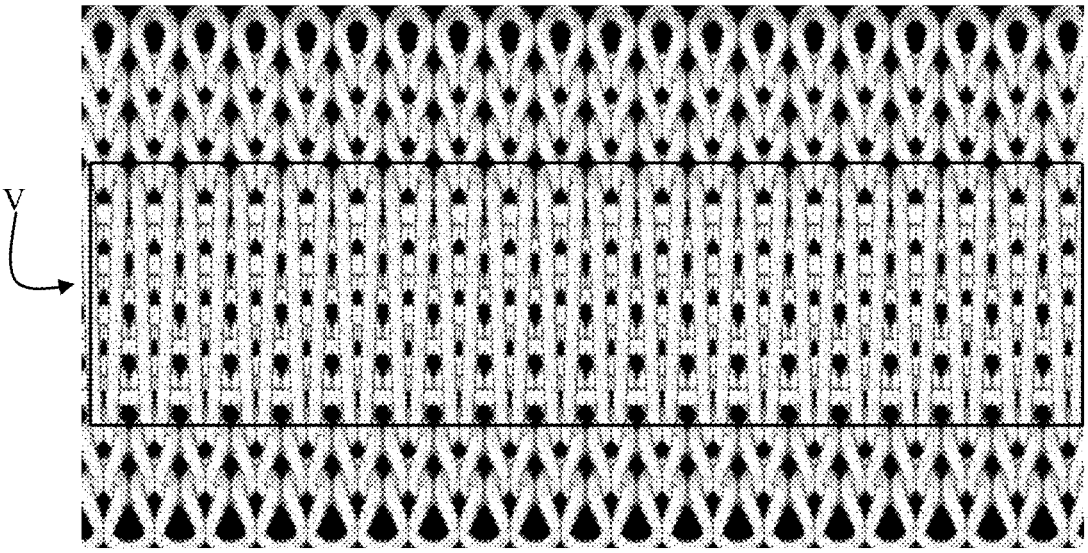
FIG. 14 is a diagram of a physical knitted fabric knitted in a manner shown in FIG. 13, wherein the fabric is shown from one side of a surface layer of the fabric.

Regarding the process of gore knitting, reference may be made to a region V shown in FIG. 13. When the yarn nozzle is going to knit a position to be knitted in the gore knitting manner, the front stitch bed and rear stitch bed do not need to be turned. Upon knitting, the needles of the yarn nozzle are arranged according to double stitches. When a valley position is knitted, the rear stitch position stops operation, whereas the face stitch (single jersey) may knit several revolutions and then get adjacent to the rear stitch. By doing so, the surface layer (corresponding to the outer side of the bag) has more stiches than the bottom layer (corresponding to the inner side of the bag), thereby forming the bulged wavy structure. In this case, the surface layer permits a larger amount of deformation, and thus the main body sheet substrate is more easily bent towards one side of the bottom layer at this position. Reference may be made to FIG. 14 for the formed region.

Figure 15:
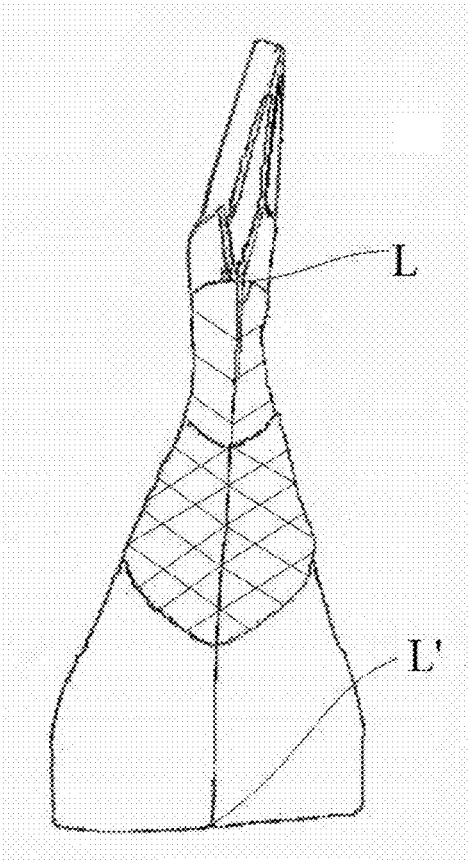
FIGS. 15 and 16 are schematic views of a knitted bag according to a second exemplary embodiment of the present invention.
Figure 16:
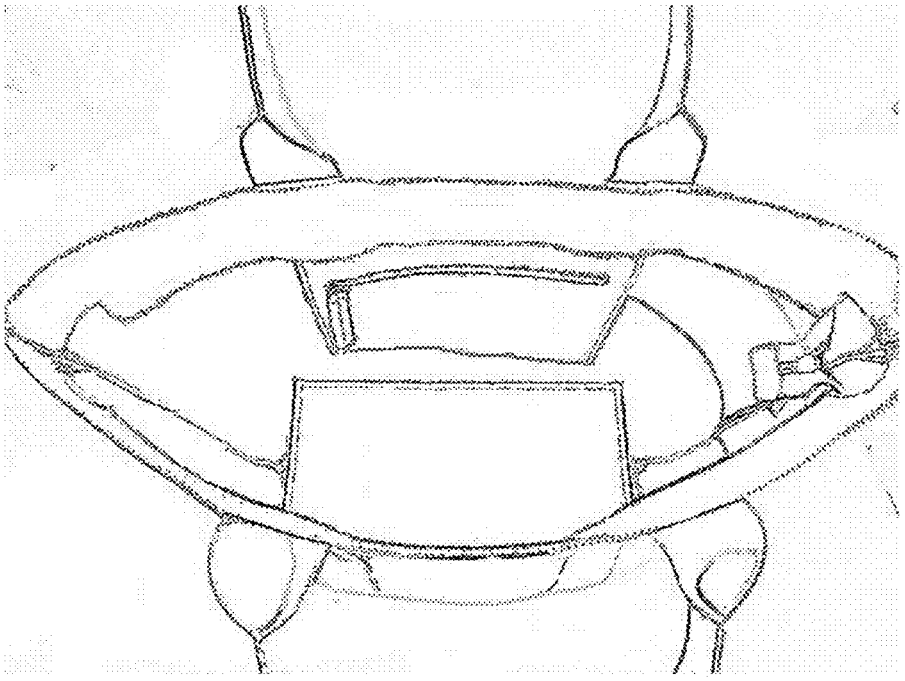
Figure 17:
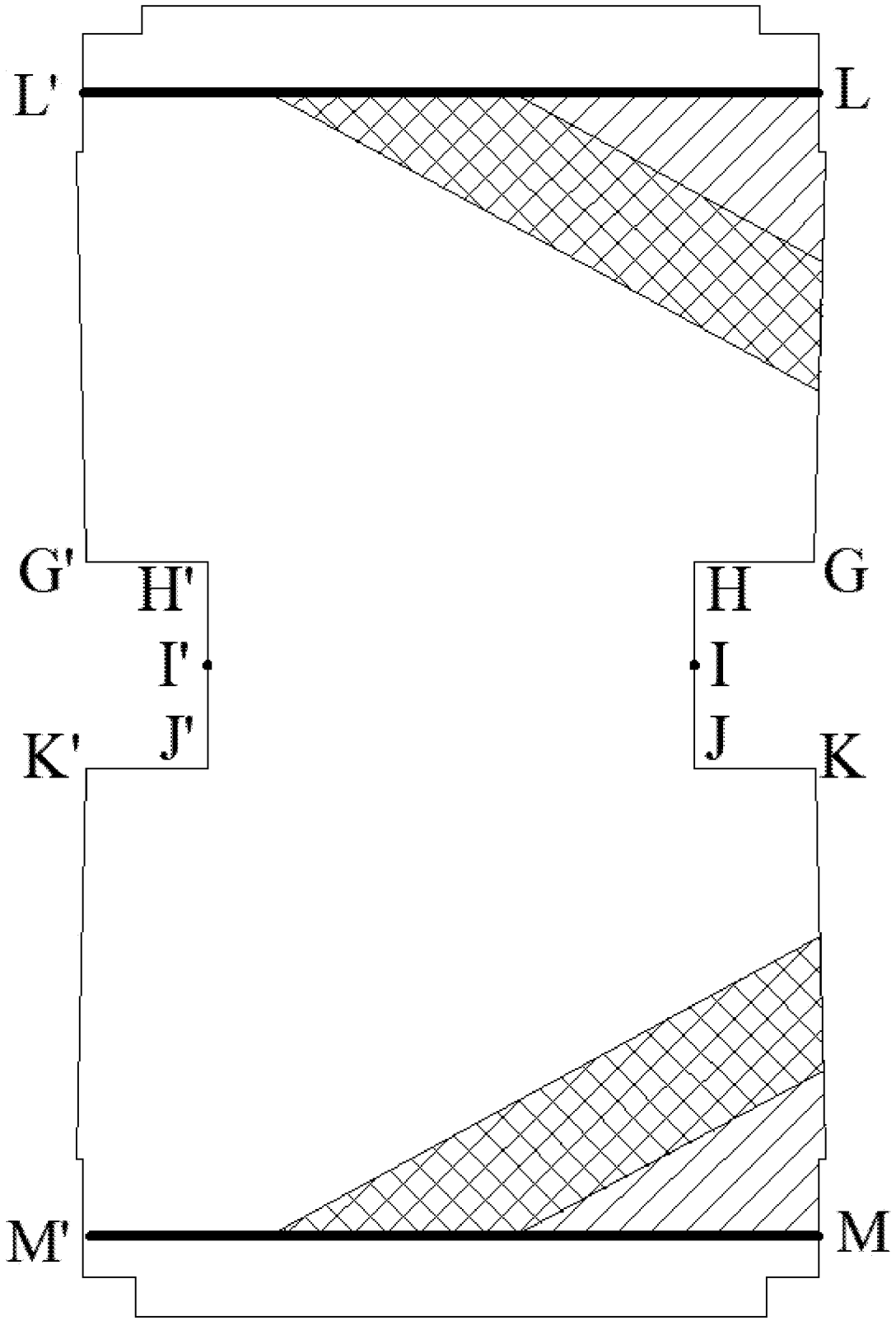
FIG. 17 is a structural schematic view of a main body sheet substrate for forming the knitted bag shown in FIGS. 11 and 12.

Another advantage of the process of gore knitting is described below in conjunction with another style of knitted bag. Referring to FIGS. 15-17, the overall structure of the bag is shown is shown in FIGS. 15-16 from different perspectives, and FIG. 17 shows the main body sheet substrate for forming the main body portion of the knitted bag shown in FIGS. 15-16. Central engagement lines LL' and MM' on the vertical surfaces at both ends of the bag in the lengthwise direction (namely, two surfaces in the thickness direction) are bent positions produced by the process of gore knitting. The bent positions are located on the surface layer (that is, the side of the knitted bag adjacent to the outside), which is a gore-knitting structure. Based on the certain restoration ability provided by the marine yarn, the marine yarns with a wavy configuration have a tendency to return to the original linear shape (or an arcuate shape bulging toward the outside), thereby driving the bottom layer located inside the knitted bag to stretch out. Thus, the knitted bag is prone to bulge toward the outside of the knitted bag at the positions made by the process of gore knitting in a natural state. The thus-made knitted bag is not prone to collapse after usage, and it can better maintain in a stable shape.

Further referring to FIGS. 3 and 17, in order to ensure that the constituent lines of the knitted bag made according to the present invention are not easily pulled out from the outside, the edge of the main body sheet substrate is set to be a piped region. As a result, various types of raw edges may be eliminated.

Figure 18:
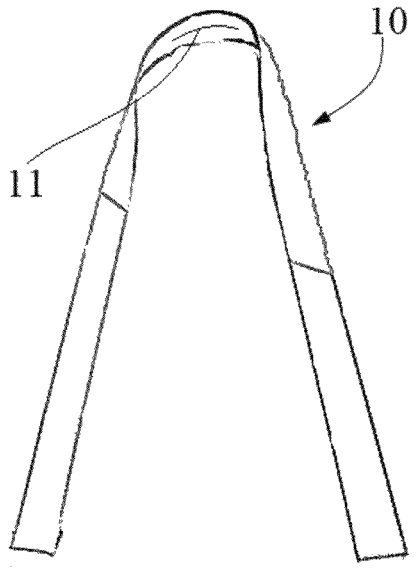
FIG. 18 is a structural schematic view of a knitted band that can be used as the handle of the knitted bag shown in FIGS. 1, 2, 15, and 17.

Referring to FIG. 18 and in conjunction with FIGS. 1-2 and 15-16, the handle 1 of the knitted bag may be optionally be made of a knitted band 10 with a multi-layer sheet-like structure as shown in FIG. 18. Specifically, the fabric in a middle region 11 of the knitted band 10 can be dropped more than one stitch as described above at a position along its longitudinal centerline so as to have a smaller number of fabric layers than the number of layers of the fabric at other positions. In this way, the knitted band 10 can be folded in half and sewed or bonded at the middle region along the longitudinal centerline of the knitted band 10 in use, to form a grip portion of the handle 1 as shown in FIGS. 1 and 2.

To further maintain the shape of the handle 1, an elongated high-density non-woven fabric (not shown) may be placed inside the folded knitted band 10. The high-density non-woven fabric has a higher hardness than the knitted band 10.

For the purpose of maintaining the shape of the bag, optionally, one or more fixing bands may be provided on the outer side of the bottom portion of the knitted bag according to the present invention, wherein the hardness of the fixing bands is greater than that of the main body sheet substrate. More preferably, the fixing bands are set as multiple bands which are arranged crisscrossed and regularly at the bottom portion of the knitted bag.

The manufacturing process of the first style of bag formed according to the concept of the present invention will be described below with reference to FIGS. 1-3 respectively. The bag according to FIGS. 1-3 may be fabricated in the following order:

The main body sheet substrate with a multi-layer sheet structure shown in FIG. 3 is produced by knitting at one time with a flyknit loom. In this embodiment, the number of fabric layers of the main body sheet substrate in the bent regions AA', BB', CC' and DD' is less than the number of fabric layers in the other regions. Preferably, the respective outer portions of the regions CC' and DD' are further provided with bent regions EE', FF' parallel thereto, and the positions at the edges of the main body sheet substrate on the respective outer sides of the bent regions EE', FF' may be used for sewing a zipper. The bent regions EE', FF' facilitates the user to operate the zipper easily.

Perform hand stitching to cut off the thread ends on the upper and lower ends of the main body sheet substrate.

Bend the main body sheet substrate along the regions AA', BB', A'B', AB', so that A'C' abuts against an upper section of the portion $U_1U_2$ shown in FIG. 3, AC abuts against a lower section of the portion $U_1U_2$ in FIG. 3, B'D' abuts against an upper section of the portion $U_3U_4$ shown in FIG. 3, and BD abuts against a lower section of the portion $U_3U_4$ in FIG. 3. In this way, the main body sheet substrate forms a preliminary form of the bag. Then, the main body sheet substrate is bent along CC', DD' to form an upper edge of the bag, whereby the main body sheet substrate is bent into a predetermined shape of the bag.

Sew adjacent edges of the main body sheet substrate to form a bag with a predetermined shape. Wherein, the threads are sewed along a path defined by $U_1U_2$ and $U_3U_4$.

Optionally, the main body sheet substrate is ironed after the hand stitching step so that the nylon thermal fuse and the marine yarn can be combined more firmly, and the shape of the main body sheet substrate is further maintained.

When a pattern is provided on the main body sheet substrate, for example, when the grid pattern shown in FIG. 3 is provided, the main body sheet substrate as shown in FIG. 3 may be placed in a groove of a measuring plate with marks and then ironed. By ironing different positions of the main body sheet substrate differently, the pattern is made to correspond to the marks on the measuring plate and thus shaped. After shaping in this way, the patterns at different positions of the bent main body sheet substrate may be displayed smoothly and continuously as shown in FIG. 1, which eliminates processes such as an additional cutting step to achieve continuous patterns in the past.

For the handle 1 portion of the knitted bag, it may be made as follows:

Provide the knitted belt 10 knitted at one time by a flyknit technique and fix the knitted band 10 on the bag, wherein the knitted band 10 has a multi-layer structure and is configured to have a smaller number of layers of fabric in the middle region along its longitudinal centerline than the number of layers of fabric at the other positions, so that the knitted band 10 may be folded in half along its longitudinal centerline to form the grip portion of the knitted bag.

The method of fabricating the knitted bag shown in FIGS. 11-13 differs from the method of fabricating the knitted bag shown in FIGS. 1-3 only in the bending manners. Below, the description is only provided for the difference. The sheet is turned 90° along KK' and GG' shown in FIG. 13, and then bend the sheet 90° along the straight line where H'J' and HJ are located, so that G'H' abuts against I'H', K'J' abuts against I'J', GH abuts against IH, and KJ abuts against IJ. After that, the bent regions are sewed to form the main body of the knitted bag shown in FIGS. 11 and 12.

It is noted that although the exemplary embodiments of the present invention are described above, those skilled in the art should understand that these are only examples. Those skilled in the art may make various changes or modifications to these embodiments without departing from the principle and essence of the present invention, but these changes and modifications all fall within the protection scope of the present invention.

The invention claimed is:

1. A knitted bag comprising:

a main body including a main body sheet substrate knitted with a flyknit loom, with the main body sheet substrate constructed to be directly sewed into a predetermined shape of the knitted bag after being stitched and bent, the predetermined shape comprising a base portion, a top portion opposite the base portion, and the knitted bag, having a height extending along a height direction from the base portion to the top portion and a length extending along a length direction, wherein the main body sheet substrate comprises a multi-layer sheet structure, and a first bent region that extends along a portion of the length of the bag and a second bent region that extends along a portion of the height of the bag, wherein the first bent region and the second bent region are formed by dropping one or more rows of stitches so that the number of layers of fabric of the main body sheet substrate in the first bent region and second bent region is smaller than a number of layers of fabric of the main body in regions other than the first bent region and the second bent region.

2. The knitted bag according to claim 1, wherein the main body sheet substrate is a sheet-like fabric knitted from nylon thermal fuses and at least one marine yarn, and has a predetermined shape.

3. The knitted bag according to claim 2, wherein the at least one marine yarn has a fineness $T_{d1}$ of that is greater than or equal to 120D and less than or equal to 180D.

4. The knitted bag according to claim 3, wherein the twist T of the at least one marine yarn is greater than or equal to 32F and less than or equal to 40F.

5. The knitted bag according to claim 4, wherein the at least one marine yarn comprises 3, 4 or 5 strands, 2 nylon thermal fuses, and a fineness $T_{d2}$ of the nylon thermal fuses is greater than or equal to 80D and less than or equal to 110D.

6. The knitted bag according to claim 2, wherein the nylon thermal fuses have a diameter d that is greater than or equal to 0.1.2 mm and less than or equal to 0.18 mm.

7. The knitted bag according to claim 6, wherein the at least one marine yarn has a fineness $T_{d1}$ that is 150D, four strands, and a twist T that is 36F; and wherein the nylon thermal fuses have a fineness $T_{d2}$ that is 90D or 100D.

8. The knitted bag according to claim 1, wherein the main body sheet substrate is constructed to form additional bent regions extending in a a widthwise direction or a height direction of the bag.

9. The knitted bag according to claim 1, wherein another portion of the first or second bent regions comprise gore knitting so that the main body sheet substrate is constructed to bulge toward an outside of the bag at the another portion of the first or second bent regions.

10. The knitted bag according to claim 1, wherein an edge of the main body Sheet substrate has a piped region.

11. The knitted bag according to claim 1, further comprising a knitted band constructed as a handle of the knitted bag and having a multi-layer sheet structure, wherein number of layers of fabric in a middle region of the knitted band at a position along a longitudinal centerline is smaller than a number of layers of the fabric at other positions, such that the knitted band is constructed to be folded in half at the middle region along the longitudinal centerline of the knitted band, to form a grip of the handle.

12. The knitted bag according to claim 1, further comprising a fixing band located at an outside of the base portion, and the hardness of the fixing band is greater than that of the main body sheet substrate.

13. The knitted bag according to claim 1, wherein the length direction is perpendicular to the height direction.

14. The knitted bag according to claim 13, wherein the first bent region extends along the base portion of the knitted bag.

15. The knitted bag according to claim 14, further comprising a third bent region that extends along a portion of the top portion of the knitted bag.

16. The knitted bag according to claim 15, wherein the third bent region is formed by dropping one or more rows of stitches so that the number of layers of fabric of the main body sheet substrate in the third bent region is smaller than a number of layers of fabric of the main body.

* * * * *